US010035361B2

(12) United States Patent
Lyon et al.

(10) Patent No.: US 10,035,361 B2
(45) Date of Patent: Jul. 31, 2018

(54) VACUUM TRANSFER DEVICE FOR ENVELOPE PRINTER

(71) Applicant: W+D North America Inc., Lenexa, KS (US)

(72) Inventors: Donald F. Lyon, Glen Head, NY (US); Mario Lisena, Glen Cove, NY (US); Greg Hudson, Hicksville, NY (US); John Lampitt, Laurelton, NY (US)

(73) Assignee: W+D NORTH AMERICA INC., Lenexa, KS (US)

( * ) Notice: Subject to any disclaimer, the term of this patent is extended or adjusted under 35 U.S.C. 154(b) by 0 days.

(21) Appl. No.: 15/278,764

(22) Filed: Sep. 28, 2016

(65) Prior Publication Data

US 2017/0087885 A1 Mar. 30, 2017

Related U.S. Application Data

(60) Provisional application No. 62/233,747, filed on Sep. 28, 2015.

(51) Int. Cl.
*B41J 13/12* (2006.01)
*B41J 11/00* (2006.01)

(52) U.S. Cl.
CPC ..... *B41J 11/0085* (2013.01); *B41J 11/0005* (2013.01); *B41J 11/005* (2013.01); *B41J 11/007* (2013.01); *B41J 13/12* (2013.01)

(58) Field of Classification Search
CPC ... B41J 11/0085; B41J 11/0005; B41J 11/005; B41J 11/007; B41J 11/02; B41J 11/057; B41J 11/13; B41J 11/20; B41J 13/00; B41J 13/0027; B41J 13/08; B41J 13/10; B41J 13/12; B41J 13/16; B41J 3/28
See application file for complete search history.

(56) References Cited

U.S. PATENT DOCUMENTS 6,336,722 B1 * 1/2002 Wotton ..... B41J 11/002 347/102
8,123,023 B2 2/2012 Williams et al.
2008/0073838 A1 * 3/2008 Sakaida ..... B41J 11/007 271/276

(Continued)

FOREIGN PATENT DOCUMENTS

EP 2853406 A1 4/2015

*Primary Examiner* — Geoffrey Mruk
*Assistant Examiner* — Scott A Richmond
(74) *Attorney, Agent, or Firm* — Thompson Coburn LLP

(57) ABSTRACT

A printable substrate transfer device for a printing machine which includes a platen that has openings therein in fluid communication with a vacuum source. A transport belt is movable over the platen in a process direction. The transport belt allows air to pass there through. A hold down plate is disposed above the transport belt. A stationary porous vacuum substrate is disposed between the hold down plate and the transport belt. The vacuum substrate and transport belt form a path there between through which a printable substrate travels. The hold down plate exerts a force toward the transport belt upon operation of vacuum passing through the platen. The vacuum substrate limits the negative pressure between the hold down plate and the transport belt, such that a force exerted by the hold down plate onto the substrate is limited.

19 Claims, 11 Drawing Sheets

(56) References Cited

U.S. PATENT DOCUMENTS

| | | | | |
|---|---|---|---|---|
| 2011/0043563 | A1* | 2/2011 | Houjou | B41J 2/155<br>347/16 |
| 2016/0060052 | A1* | 3/2016 | Tojima | B65H 3/126<br>347/104 |
| 2016/0152053 | A1* | 6/2016 | Oe | B41J 11/007<br>347/16 |

* cited by examiner

VACUUM TRANSFER DEVICE FOR ENVELOPE PRINTER

The present application claims the benefit of priority to U.S. Provisional Patent Application Ser. No. 62/233,747 filed on Sep. 28, 2015, the contents of which are incorporated by reference herein in its entirety.

TECHNICAL FIELD

The present disclosure relates to a device for transferring a printable substrate in a printing machine and more particularly an envelope hold down and vacuum transfer device.

BACKGROUND

Printing machines include a print unit where an image is imparted on a printable substrate and a transfer unit that carries the substrate along a process path to and through the print unit. Print units may include direct printing devices such as inkjet units. Inkjet printing units include a plurality of print heads that emit drops of ink onto the printable substrate in a tightly controlled manner to create an image.

With print units such as inkjet print units, it is desirable for image quality that the distance between the printable substrate's upper surface and the face of the inkjet print heads is kept consistent. The distance can be very small, on the order of a 0.010"–0.040". The printable substrate must be maintained in a uniformly flat orientation as it travels under the print heads in order to prevent the substrate from engaging the print heads. The print heads can be damaged if the printable substrate engages them.

The transfer device can include a hold down device that restrains the printable substrate on a transfer belt. The hold down device also attempts to flatten the printable substrate before the printable substrate travels under the print heads. The substrate can have thickness variations caused by waves or ripples in the substrate. Various methods of holding and flattening the substrate have been used including vacuum hold downs. However, increasing the vacuum level to try and flatten and smooth out a substrate can lead to increased friction between the transport belt and the underlying surface over which the transport belt passes. This can lead to operational and maintenance problems.

Furthermore, substrates, such as envelopes, which have multiple layers and an unsecured flap, are especially difficult to hold in a uniformly flat orientation. The vacuum belt acts primarily on the bottom layer of the envelope and does not smooth out the top layer which is adjacent to the print heads. Also, the high speed associated with envelope printing further complicates the task of retaining and transporting the envelope such that the top surface remains within a predetermined distance from the print heads.

Accordingly, it would be desirable to provide a transfer device that transports a printable substrate and flattens its surface prior to entering the print unit.

SUMMARY

The present disclosure provides a printable substrate transfer device for a printing machine including a platen that has openings therein in fluid communication with a vacuum source. A transport belt is movable over the platen in a process direction. The transport belt allows air to pass there through. A hold down plate is disposed above the transport belt. A stationary porous vacuum substrate is disposed between the hold down plate and the transport belt. The vacuum substrate and transport belt form a path there between through which a printable substrate travels. The hold down plate exerts a force toward the transport belt upon operation of vacuum passing through the platen. The vacuum substrate limits the negative pressure between the hold down plate and the transport belt, such that a force exerted by the hold down plate onto the substrate is limited.

The present disclosure also provides a printing device including a platen having a plurality of openings therein in fluid communication with a vacuum source. A printing unit imparts an image on a substrate. A transport belt is movable in a process direction over the platen. The transport belt allows air to pass there through. A hold down plate is disposed above the transport belt. The platen has a first set of slots each of the first set of slots having a longitudinal extent extending in the process direction. The platen has a second set of slots disposed downstream of the first set of slots and aligned with the printing unit. Each of the second set of slots has a longitudinal extent extending in a cross-process direction, and each slot contains at least one of the plurality of openings therein. The present disclosure further provides a method for transferring a printable substrate through a printing machine including delivering a printable substrate to a print unit via a transfer device, the transfer device including:

a platen having openings therein in fluid communication with a vacuum source;

a transport belt movable in a process direction over the platen, the transport belt allowing air to pass there through;

a hold down plate disposed above the transport belt; and a porous vacuum substrate disposed between the hold down plate and the transport belt, the vacuum substrate and transport belt forming a path through which the printable substrate travels, applying a vacuum to the platen to secure the printable substrate to the transport belt;

operating the transport belt to convey the printable substrate between the vacuum substrate and transport belt, the hold down plate exerting a force onto the printable substrate to flatten the printable substrate, the vacuum substrate permitting air to be drawn into a space between the hold down plate and the transport belt thereby limiting the negative pressure between the hold down plate and the transport belt and the force exerted by the hold down plate onto the printable substrate;

transporting the printable substrate in the process direction to the print unit; and imparting an image on the printable substrate with the print unit.

DETAILED DESCRIPTION

Figure 1:
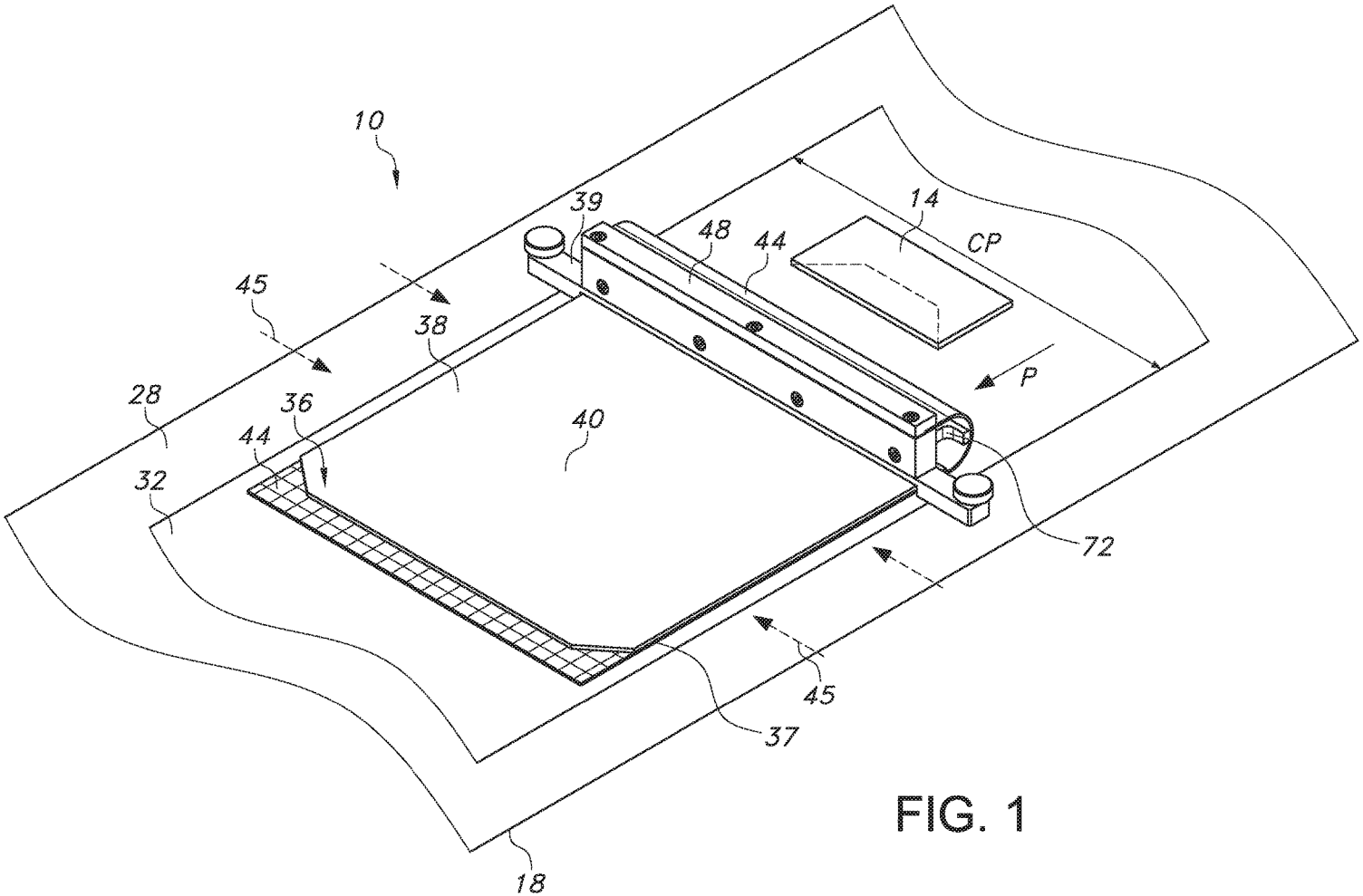
FIG. 1 is a perspective view of a transfer device.
Figure 2:
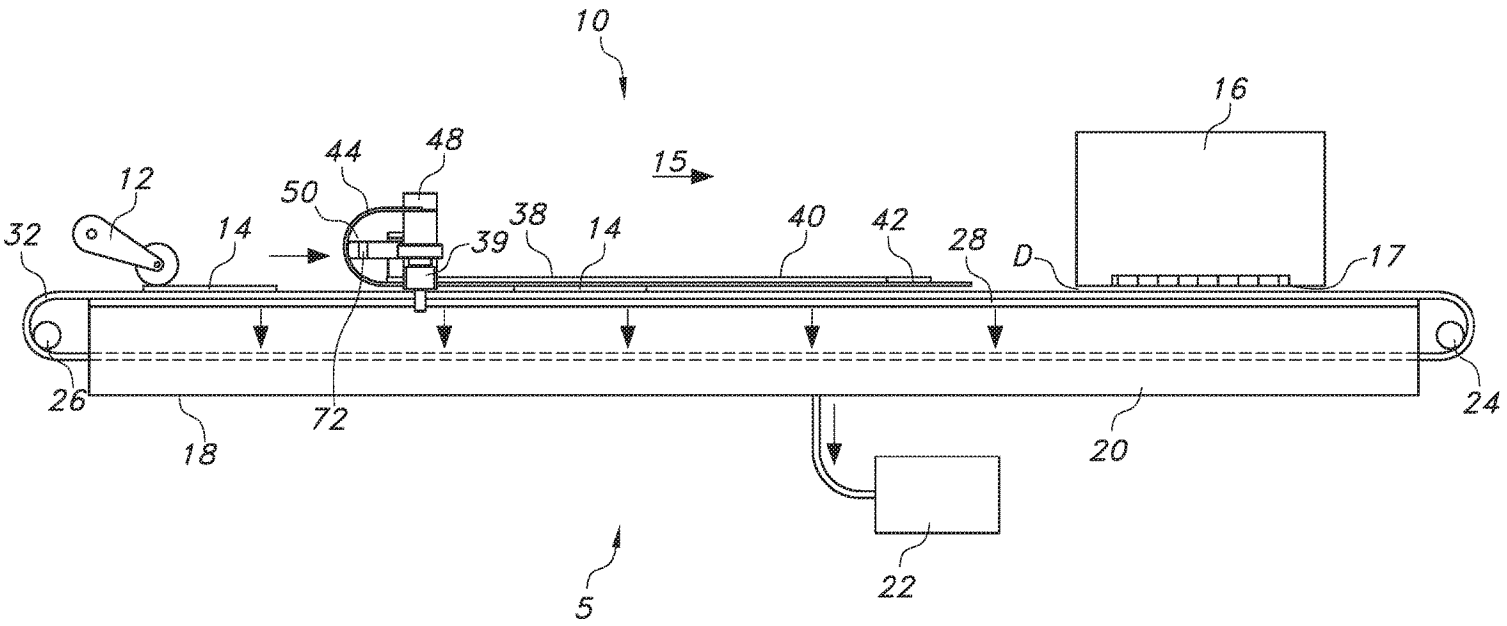
FIG. 2 is a side view of the transfer device on a printing machine.
Figure 3:
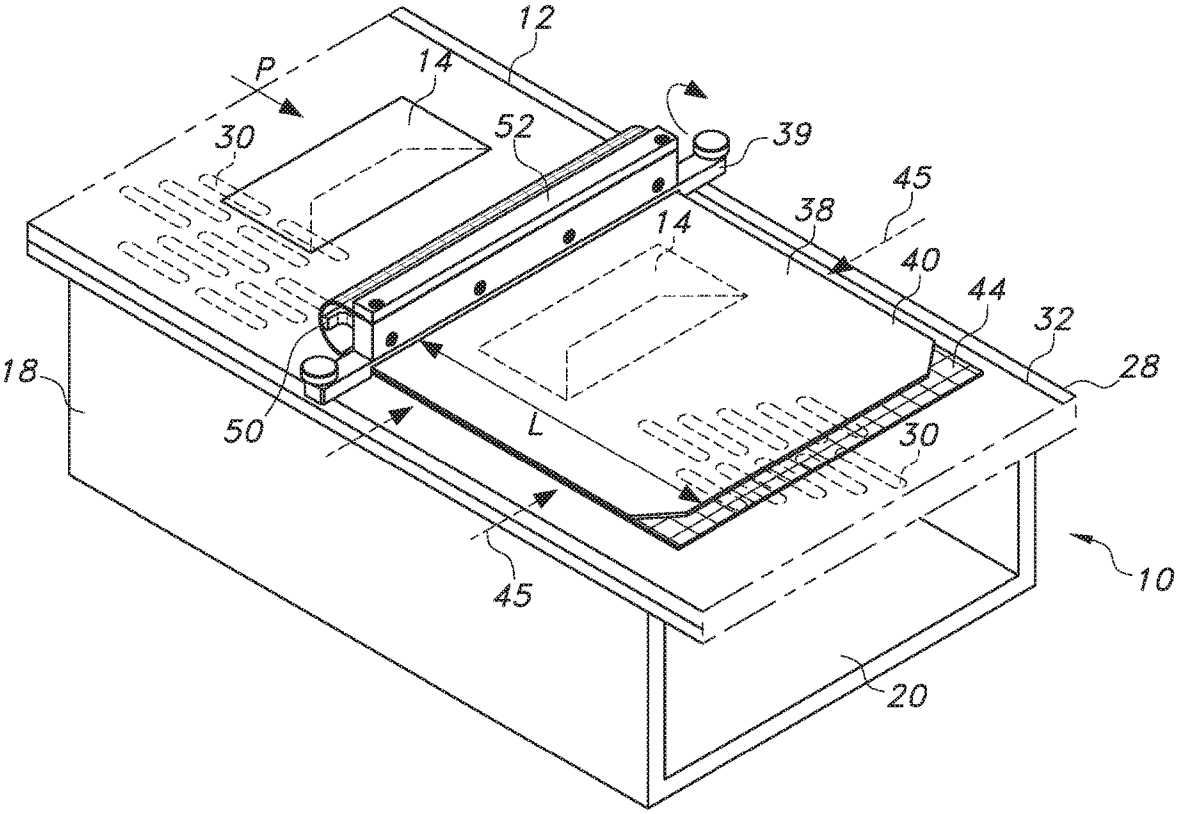
FIG. 3 is a top perspective view of the transfer device.

With reference to FIGS. 1-3, a vacuum transfer device 10 is shown. The transfer device 10 may be used in a printing machine 5 having a feed unit 12 for holding and feeding downstream a printable substrate 14, such as an envelope, and a printing unit 16 for applying an image to the printable substrate 14. The transfer device 10 transports the envelope 14 from the feed unit 12 downstream in a process direction (shown by arrow 15 in FIG. 2) to the print unit 16 and onward to an exit station (not shown) where the printable substrate 14 having the imparted image is collected. While the printable substrate is shown in the form of an envelope, it is contemplated that the printable substrate may be in the form of sheets or other printable matter.

As shown in FIG. 2, the print unit 16 may be a digital printer having a plurality of print heads 17 which are controlled to apply ink to the printable substrate 14. The distance D between the print heads 17 and the surface of the printable substrate 14 may be very close, e.g., 0.010"-040". In order to prevent the printable substrate 14 from engaging the print heads, the surface of the printable substrate 14 is preferably uniformly flat without any buckled or raised portions. The transfer device 10 with the hold down unit 36 described below flattens the printable substrate 14 and delivers it to the print unit 16 ready for printing.

The transfer device 10 may include a vacuum table 18 having an internal plenum 20 operably connected to a vacuum source 22. The vacuum table 18 may extend in the process direction between the feed unit 12 and the exit station. The vacuum table 18 may be bounded at its ends by a conveyor drive roller 24 and an idler roller 26. The drive roller 24 is operably connected to a rotary drive unit (not shown) in a manner known in the art. The vacuum table upper surface may include a platen 28 having a plurality of openings 30 in fluid communication with the plenum 20. In this way, air may be drawn though the platen 28 via the vacuum source 22. The two rollers drive an endless transport belt 32 over the surface of the table 18. The transport belt 32 may be formed of a porous nylon mesh material and have an air passage rate in the range of approximately 240 to 900 cfm and preferably approximately 240 cfm. Accordingly, vacuum is drawn though the platen 28 and transport belt 32. The vacuum may therefore act on the printable substrate 14 to secure it to the transport belt 32 and permit the transport belt to transport the printable substrate through the printing machine 5.

Figure 4:
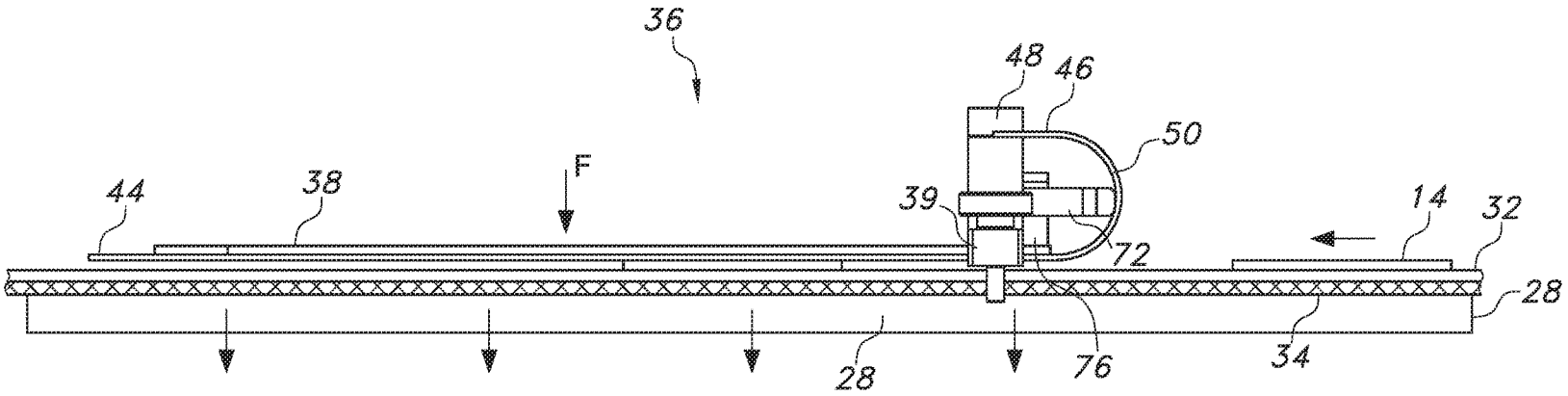
FIG. 4 is a side elevational view of the transfer device

In one embodiment, the transport belt slides directly over the platen surface as shown in FIGS. 2 and 3. In an alternative embodiment shown in FIG. 4, a porous mat 34 may be disposed between the platen 28 and the transport belt 32. In one embodiment, the mat 34 may extend along the hold down unit 36 and the print unit 16. In a further alternative embodiment, the mat 34 may only be positioned between the platen 28 and the belt at the location beneath the print unit 16. The mat 34 may be stationary and remains fixed as the belt 32 travels over it. The mat 34 may be formed of a porous nylon mesh material and may have an air passage rate of approximately 80 to 100 cfm. The mat 34 preferably has a width the same or greater than the width of the transport belt 32. The vacuum air flow rate experienced by the printable substrate 14 on the transport belt 32 is a function of the air passage rate of both the transport belt 32 and the mat 34. Therefore, the use of the stationary mat 34 allows the vacuum air flow acting on the envelope to be controlled to a desired level. The mat 34 may be used to reduce the vacuum flow to a desired level. By using the mat 34 between the platen 28 and printable substrate 14, the porosity of the transport belt 32 may be greater than if the belt were to be used alone. A belt with greater porosity is less susceptible to clogging from such contaminants as paper dust and/or ink, and also allows the transport belt to be more easily cleaned. The mat 34 which extends across the length platen does not wrap around rollers like the transport belt 32 does. Therefore, the mat 34 may be removed for cleaning or replacement relatively easily compared to removing the transport belt 32. Therefore, the use of the mat 34 reduces maintenance costs.

While certain cfm numbers have been set forth above for the transport belt 32 and the mat 34, it should be understood that transport belts and mats having different air passage rates may be used to achieve a desired vacuum flow in order to obtain a desired hold down force. It is also contemplated that no mat is used and the belt 32 runs directly over, and in contact with, the platen 28 as shown, for example, in FIGS. 2 and 3.

The mat 34 may also be used in order to raise the surface of the transport belt in order to adjust the distance between the transport belt's surface and the print heads 17. In this way, adding or removing the mat 34 can allow the printing machine 5 to accommodate printable substrates 14 having different thicknesses. For example, when a multilayer printable substrate 14, such as an envelope, is being printed, the distance between the belt surface and the print heads needs to be greater than if a thinner single layer printable substrate, such as a sheet, is being printed. When a thinner sheet is being printed, the mat 34 can be inserted between the platen 28 and the transport belt 32 in order to raise the transport belt to maintain a desired spacing between the print heads and the printable substrate.

With further reference to FIGS. 4-9, the transfer device 10 includes a hold down unit 36 which aids in flattening the printable substrate 14 and uniformly securing it to the moving transport belt 32. The hold down unit 36 facilitates a high speed travel of printable substrate 14 into the print unit 16 without damaging the print heads 17. The hold down unit 36 may include a hold down plate 38, having an upper surface 40 and lower surface 42, disposed above the transport belt 32, FIG. 8. The plate 38 may be formed of a rigid, non-porous material such as steel or aluminum, which allows for no appreciable amount of air to flow there through. In one embodiment, the hold down plate 38 may be formed from a sheet of aluminum. The lower surface 42 may be smooth and interrupted.

A stationary porous vacuum substrate 44 is disposed between the hold down plate 38 and the transport belt 32. The vacuum substrate 44 may extend under the entire length of the hold down plate 38. Printable substrate 14, such as envelopes, carried by the transport belt 32 travel beneath the vacuum substrate 44 and under the hold down plate 38. The vacuum substrate 44 may be a porous pliable material such as nylon having an air passage rate in the range of about 500 to 1,000 cfm and preferably 650 cfm. The vacuum substrate may have a relatively smooth surface so that the printable substrate can slide in relation thereto. The vacuum substrate 44 allows air to pass there through as shown by dashed arrows 45 in FIGS. 1 and 3. The hold down plate 38 may have a length, L, between 12 and 24 inches. This length gives the hold down unit sufficient time for the envelopes to be smoothed and flattened out as they travel under the hold down plate 38.

The air flowing though the platen holes 30 creates a vacuum that tends to pull the plate 38 downwardly to the platen 28 with a certain force F. This force exerted by the hold down plate 38 acts on the printable substrate 14 and smoothens out any irregularities or wrinkles in the printable substrate 14 and presses it firmly onto the transport belt 32. The printable substrate 14, therefore, has a substantially uniform height throughout its surface. The vacuum substrate 44 spaces the hold down plate 38 from the transport belt 32. Therefore, the porous vacuum substrate 44, which is in the space between the hold down plate bottom surface 42 and the transport belt, allows some air to flow, 45, through the vacuum substrate 44 and around the perimeter edges 37 of the hold down plate thereby limiting the vacuum level, or negative pressure, beneath the hold down plate 38. By reducing the vacuum level, i.e., the negative pressure, the hold down plate's downward force, F, is thereby reduced. Therefore, plate force, F, is sufficient to permit the hold down plate 38 to flatten and smooth out any irregularities in the printable substrate 14 but is not so great that it causes excessive friction or prevents the printable substrates 14 from being transported by the belt 32. Accordingly, the vacuum substrate 44 allows for a sufficient level of vacuum to be used to flatten and hold the printable substrate 14 to the transport belt, while limiting the plate's downward force to a desired level.

In addition, the flow of air thought the vacuum substrate 44 permits air to flow around the printable substrate 14. This air flow causes paper dust to be drawn away from the printable substrate 14 thereby helping to increase print quality.

The vacuum substrate 44 is stationary in that it does not move relative to the transport belt 32 during operation. With reference to FIGS. 4-9, in order to positionally fix the vacuum substrate 44, its leading end 46 may be secured to a clamp including a clamp plate 48 which is fixed to a rigid bar 39 extending across the transport belt 32. The leading end 46 is clamped between the clamp plate 48 and bar 39. The bar 39 may be removably secured to the platen 28 by hold down fasteners 70. The vacuum substrate 44 may have a curved portion 50 leading from the clamp plate 48 to the portion that lies beneath the hold down plate 38. The curved portion 50 tends to guide the printable substrate 14 in under the vacuum substrate 44 and hold down plate 38. The curved portion 50 is formed with a shape that does not tend to lift the leading edge of the hold down plate 38 away from the transport belt 32. Accordingly, the hold down plate 38 may remain in a substantially parallel orientation relative to the transport belt 32.

In order to help form and maintain the shape of the curved portion 50, a support 72 may be fixedly secured to the bar 39. With additional reference to FIGS. 5 and 9, the support 72 may extend outwardly in the upstream direction (opposite to the downstream or process direction) from the bar 39. The support 72 has a length extending in the cross-process direction, C, across the entire width of the vacuum substrate 44. The support 72 may include a rigid member with a continuous uninterrupted front surface 74. The distance of the support from the platen 28 may be selected to form the curved portion 50 having the desired configuration. The vacuum substrate 44 is wrapped around and engages the front surface 74. As the transfer belt moves beneath the vacuum substrate 44, it will tend to pull the vacuum substrate 44 in the process direction, P. The support 72 maintains the shape of the curved portion 50 by resisting the downstream pull on the vacuum substrate 44.

Figure 5:
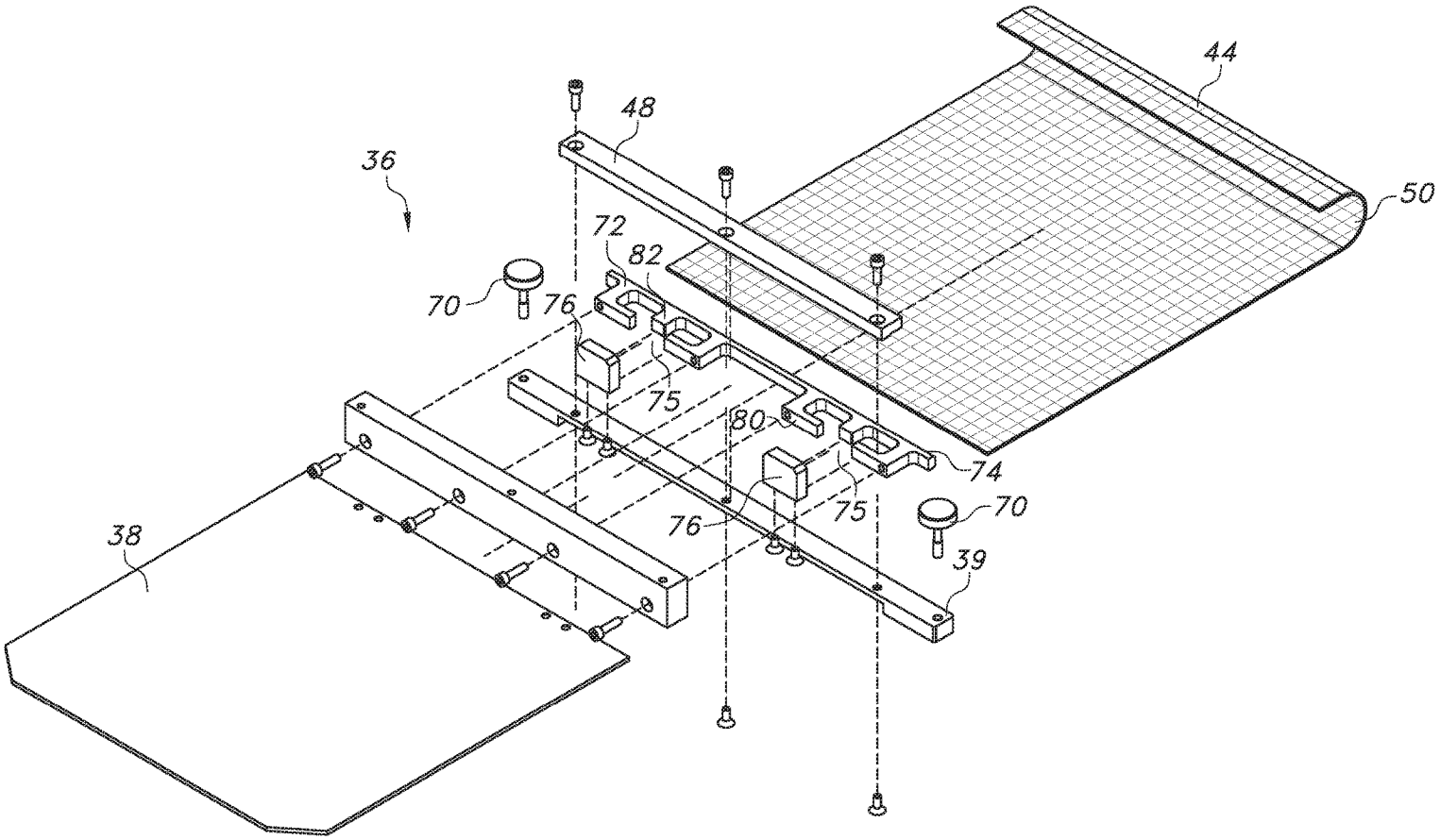
FIG. 5 is an exploded view of a hold down unit.
Figure 6:
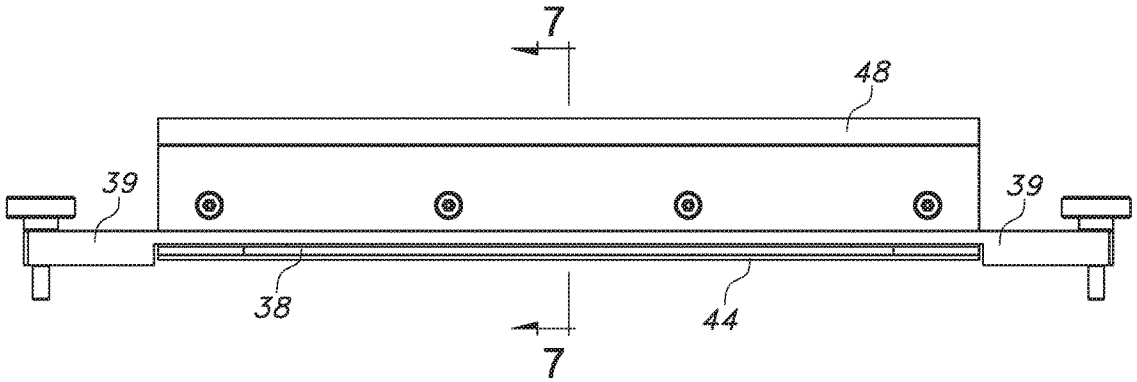
FIG. 6 is a rear elevational view of the hold down unit.
Figure 7:
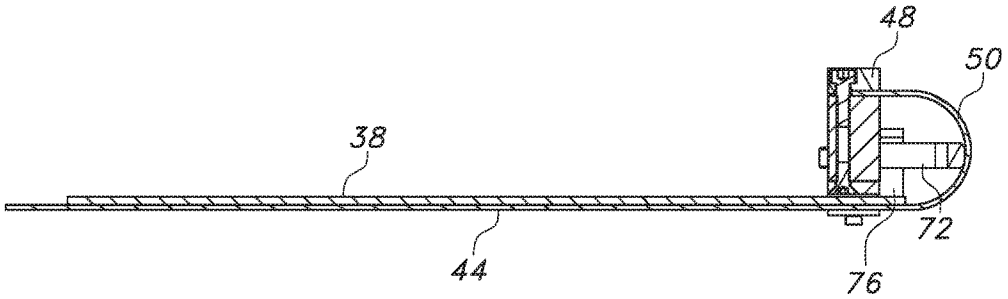
FIG. 7 is a side cross-section elevational view of the hold down unit taken along line 7-7 of FIG. 6.
Figure 8:
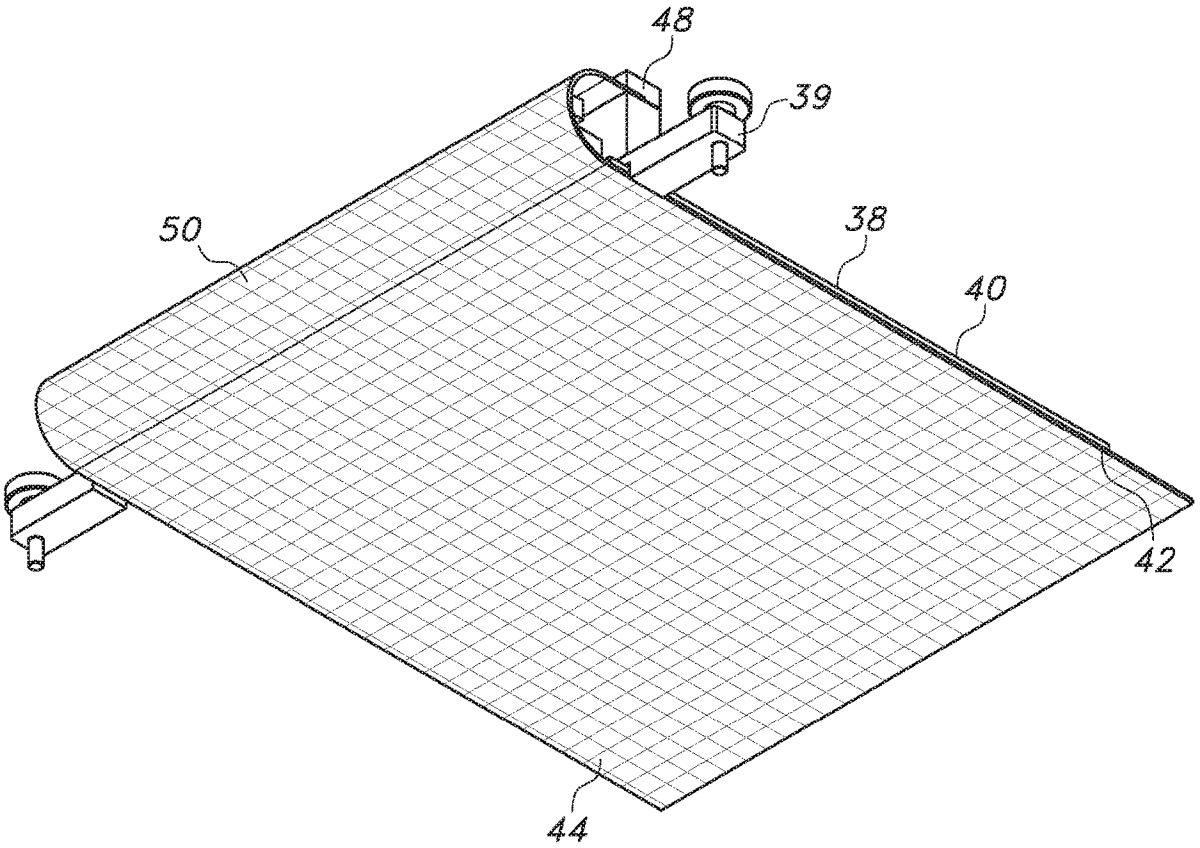
FIG. 8 is a bottom perspective view of the hold down unit.
Figure 9:
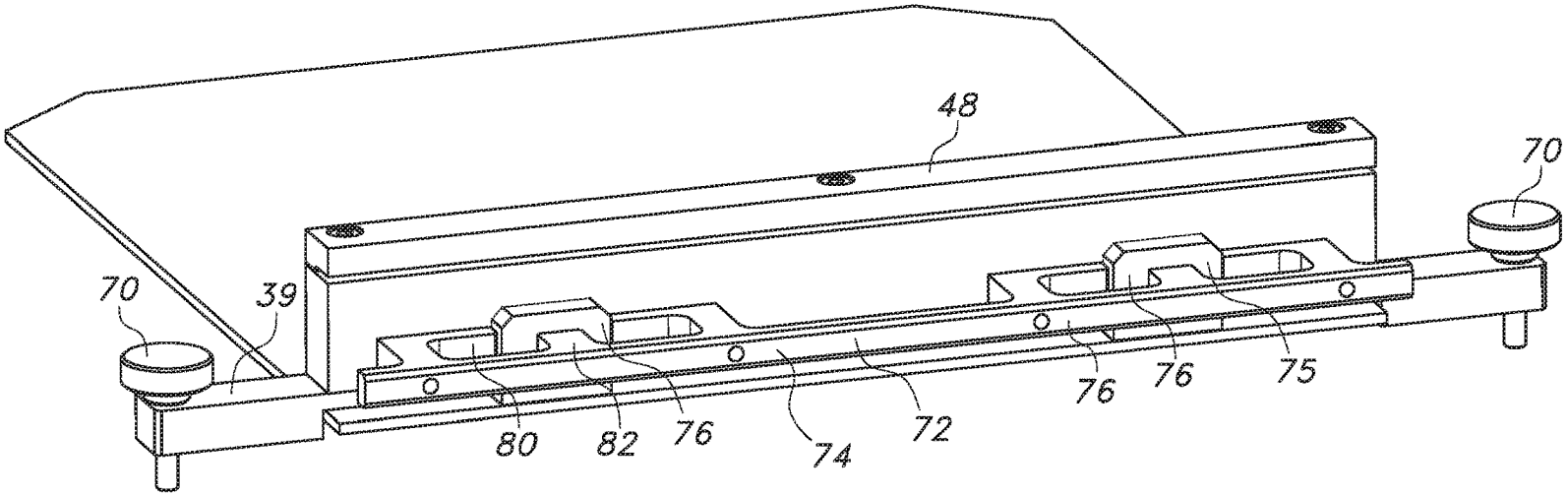
FIG. 9 is a top perspective view of the hold down with a vacuum substrate removed.

As shown in FIGS. 5 and 9, the support 72 may include a plurality of slots 75 formed therein which slidably receives tabs 76 extending from and secured to the hold down plate 38. The tabs 76 may be spaced in the cross-process direction and extend upwardly from the plate into the support slots 75. The slots 75 permit the tabs 76, and the hold down plate 38 secured thereto, to move up and down with respect to the support 72, the platen 28 and transfer belt 32, but restrict movement in the process or cross-process direction. Therefore, the hold down plate 38 is free to move toward the platen upon the application of vacuum so that the plate 38 can smooth the printable substrate 14 traveling between the hold down plate 38 and the platen 28.

Each of the support slots 75 may be formed by a pair of arms 80 extending toward each other and a lug 82 extending toward a space 84 defined by the end of the arms 80. The tab 76 is retained by the arms 80 and the lug 82 as shown in FIG. 9. It is further contemplated that the support slot 75 could be formed by openings in the support 72 having different configurations.

Figure 10:
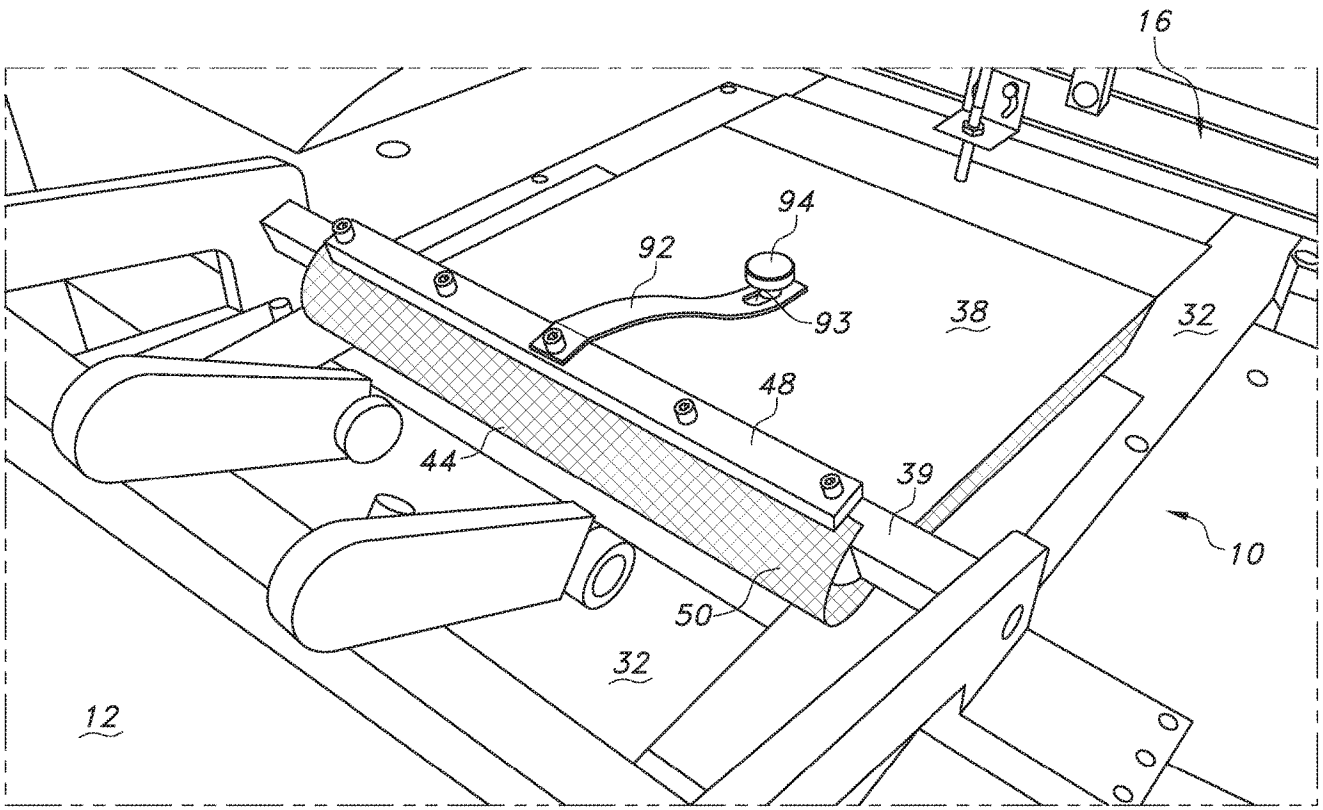
FIG. 10 is a perspective view of an alternative embodiment of a transfer device.

In an alternative embodiment shown in FIG. 10, the bar 39 may be pivotable about its longitudinal axis and then fixed in a desired position. The bar 39 and clamp plate 48 thereon may be pivoted to allow the clamped leading edge of the vacuum substrate 44 to be rotated to adjust the degree of curve of the vacuum substrate's curved portion 50. When the desired degree of curve is obtained, the bar 39 may be fixed in position by a fastener. The curvature is maintained by the rigidity of the vacuum substrate material. As in the embodiment described above, the curved portion 50 is formed such that it does not tend to lift the leading edge of the hold down plate 38 away from the transport belt 32. Accordingly, the hold down plate 38 remains in a substantially parallel orientation relative to the transport belt 32.

The hold down plate 38 may be restrained from traveling downstream by a strap or tether 92 secured to the hold down plate 38. One end of the strap is secured to the hold down plate 38 by a fastener 94 and the other end is secured to the bar 39 or other fixed portion of the printing machine 5. The position of the hold down plate 38 may be adjusted in either upstream and downstream directions by a groove 93 formed on the end of the strap. The loosening of the fastener 94 permits the hold down plate 38 to be moved along the length of the groove 93. When the desired portion is achieved, the fastener 94 may be tightened, thereby fixing the position of the hold down plate 38. The strap 92 may have a degree of flexibility to allow the hold down plate 38 to be lifted upwardly away from the transport belt 32 to permit the hold down plate 38 to move away and toward the belt to accommodate printed substrates 14 having different thicknesses. Movement of the hold down plate 38 also allows for maintenance to be performed, such as clearing jams. In one embodiment the strap 92 is formed of spring steel.

Figure 11:
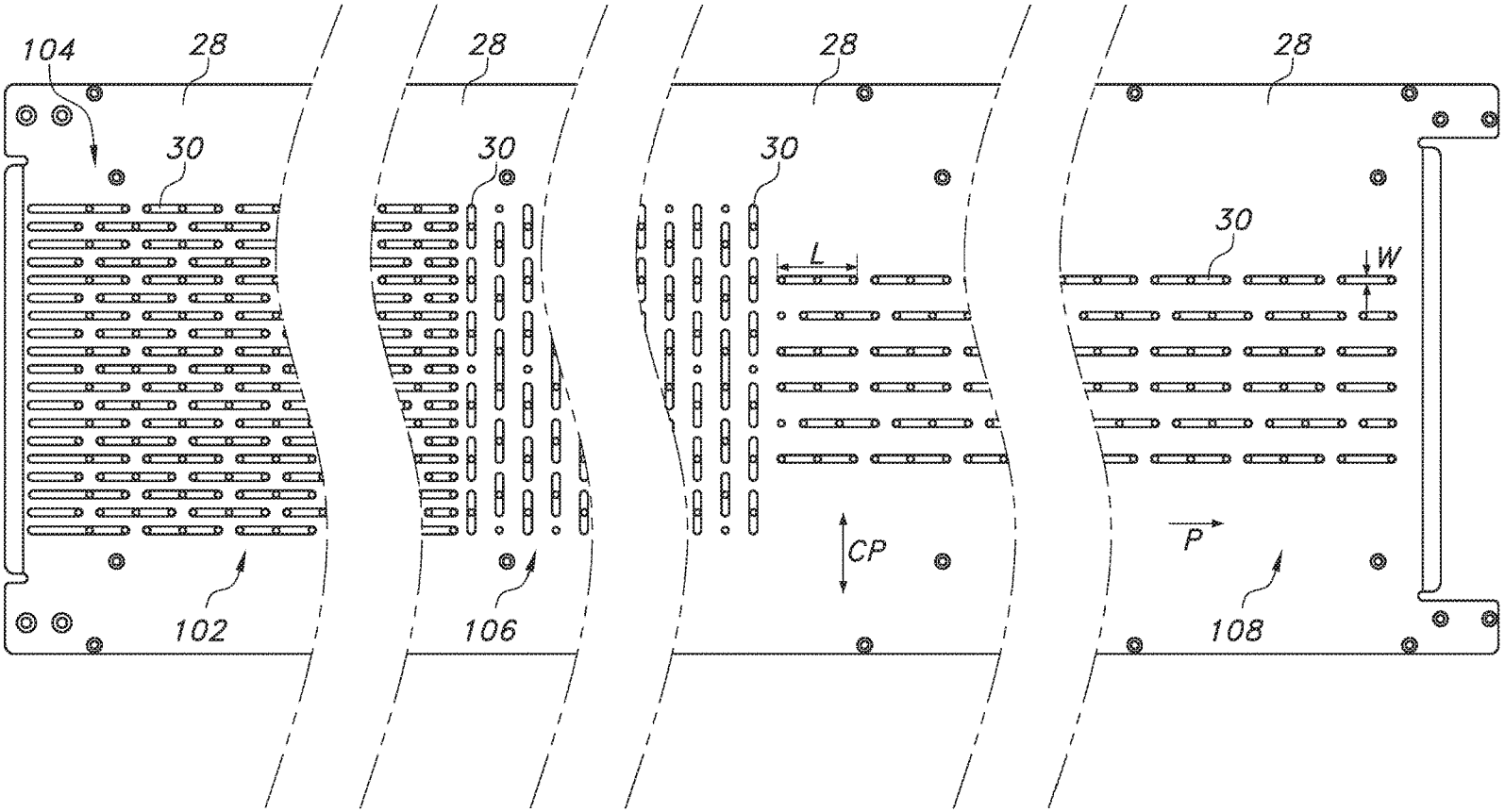
FIG. 11 is a top plan view of platen.
Figure 12:
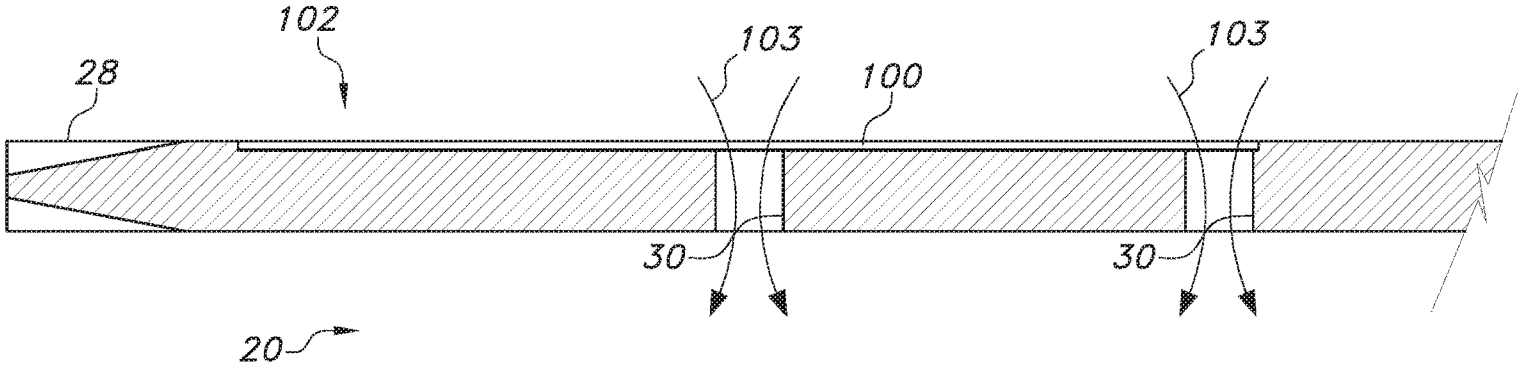
FIG. 12 is a cross-sectional view of a platen slot.

With reference to FIGS. 11 and 12, the platen 28 may include a plurality of openings 30 in communication with the vacuum plenum 20. One or more openings are disposed in the plurality of slots 102. The openings 30 extend from the bottom of the slot through the thickness of the platen in order to permit air 103 to flow therethrough. The slots 102 have a longitudinal L, extent which is greater than its width, W. The platen 28 includes a first set of slots 104 each having a longitudinal extent extending in the process direction P. The first set of slots 104 may be located on the platen disposed upstream of the print unit 16.

The platen 28 may further include a second set of slots 106 that are disposed beneath the print unit. At the location where the ink is being transferred to the printable substrate, it is desirable to reduce or eliminate any air flow caused by the vacuum. Such air flow can disturb the ink transfer and degrade the image being imparted onto the printable substrate 14. Accordingly, each of the second set of slots 106 has a longitudinal extent extending in the cross-process direction, CP. When the printable substrate travels over the second set of slots 106, each of the slots and openings 30 therein will be completely covered by the printable substrate during the ink transfer by the print unit. This reduces the amount of uncovered openings which would allow air to flow during the ink transfer.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A printable substrate transfer device for a printing machine comprising:

a platen having openings therein in fluid communication with a vacuum source;

a transport belt movable over the platen in a process direction, the transport belt allowing air to pass there through;

a hold down plate disposed above the transport belt; and a stationary porous vacuum substrate disposed between the hold down plate and the transport belt, the vacuum substrate and transport belt forming a path there between through which a printable substrate travels, the hold down plate exerting a force downwardly toward the transport belt upon operation of vacuum passing through the platen, the vacuum substrate limiting the negative pressure between the hold down plate and the transport belt, such that a force exerted by the hold down plate onto the substrate is limited.

2. The device as defined in claim 1, wherein the vacuum substrate has a curved portion disposed upstream of the hold down plate for guiding travel of the printable substrate.

3. The device as defined in claim 1, wherein the vacuum substrate is formed of a pliable material.

4. The device as defined in claim 1, wherein a stationary porous mat is disposed between the platen and the transport belt, the mat allowing air to pass there through.

5. The device as defined in claim 1, wherein the vacuum substrate is retained by a clamp operably connected to the platen and the vacuum substrate has a curved portion disposed upstream of the hold down plate for guiding travel of the printable substrate.

6. The device as defined in claim 5, wherein the clamp includes a support extending therefrom in a direction opposite of the process direction, the support includes a slot therein and the hold down plate includes tab extending therefrom, the tab being insertable in the slot, wherein the support restricts movement of the hold down plate in the process direction and permits the plate to move toward and away from the transport belt.

7. The device as defined in claim 6, wherein the support includes a plurality of slots and the hold down plate includes a plurality of tabs, each of the slots slidably receiving therein one of the plurality of tabs.

8. The device as defined in claim 1, wherein the hold down plate is secured to a support bar, wherein movement of the hold down plate in the process direction is restricted and movement of the hold down plate toward and away from the platen is permitted.

9. The device as defined in claim 1, wherein the vacuum substrate permits air to flow between the platen and perimeter edges of the hold down plate.

10. The device as defined in claim 9, wherein the hold down plate has a planar surface and is formed of a non-porous material.

11. The device as defined in claim 1, wherein the platen has a first set of slots and each of the first set of slots having a longitudinal extent extending in the process direction.

12. The device as defined in claim 11, wherein the platen has a second set of slots disposed downstream of the first set of slots, each of the second set of slots having a longitudinal extent extending in a cross-process direction.

13. A printing device comprising:

a platen having a plurality of openings therein in fluid communication with a vacuum source;

a printing unit for imparting an image on a substrate;

a transport belt movable in a process direction over the platen, the transport belt allowing air to pass there through;

a hold down plate disposed above the transport belt; and the platen having a first set of slots, each of the first set of slots having a longitudinal extent extending in the process direction and the platen having a second set of slots disposed downstream of the first set of slots and aligned with the printing unit, each of the second set of slots having a longitudinal extent extending in a cross-process direction, and each slot containing at least one of the plurality of openings therein;

wherein a porous vacuum substrate is disposed between the hold down plate and the transport belt, the vacuum substrate and transport belt forming a path through which a printable substrate may travel.

14. The printing device as defined in claim 13, wherein the hold down plate exerts a force downwardly toward the transport belt upon operation of the vacuum and the vacuum substrate permitting air to be drawn into a space between the hold down plate and the transport belt thereby limiting the negative pressure between the hold down plate and the transport belt and the force exerted by the hold down plate onto the printable substrate.

15. The device as defined in claim 13, wherein the vacuum substrate has a curved portion disposed upstream of the hold down plate for guiding travel of the printable substrate.

16. The device as defined in claim 13 wherein the vacuum substrate is formed of a pliable material.

17. A method for transferring a printable substrate through a printing machine comprising:

delivering a printable substrate to a print unit via a transfer device, the transfer device including:

a platen having openings therein in fluid communication with a vacuum source;

a transport belt movable in a process direction over the platen, the transport belt allowing air to pass there through;

a hold down plate disposed above the transport belt; and a porous vacuum substrate disposed between the hold down plate and the transport belt, the vacuum substrate and transport belt forming a path through which the printable substrate travels, applying a vacuum to the platen to secure the printable substrate to the transport belt;

operating the transport belt to convey the printable substrate between the vacuum substrate and transport belt, the hold down plate exerting a force onto the printable substrate to flatten the printable substrate, the vacuum substrate permitting air to be drawn into a space between the hold down plate and the transport belt, thereby limiting the negative pressure between the hold down plate and the transport belt and the force exerted by the hold down plate onto the printable substrate;

transporting the printable substrate downstream in the process direction to the print unit; and imparting an image on the printable substrate with the print unit.

18. The device as defined in claim 17, wherein the platen has a first set of slots and each of the first set of slots having a longitudinal extent extending in the process direction.

19. The device as defined in claim 18, wherein the platen has a second set of slots disposed downstream of the first set of slots, each of the second set of slots having a longitudinal extent extending in a cross-process direction.

* * * * *